US006790082B2

(12) United States Patent
Obayashi

(10) Patent No.: US 6,790,082 B2
(45) Date of Patent: Sep. 14, 2004

(54) COAXIAL CABLE CONNECTOR

(75) Inventor: Katsuaki Obayashi, Yokohama (JP)

(73) Assignee: I-Pex Co., Ltd., Tokyo (JP)

( * ) Notice: Subject to any disclaimer, the term of this patent is extended or adjusted under 35 U.S.C. 154(b) by 233 days.

(21) Appl. No.: 10/058,041

(22) Filed: Jan. 29, 2002

(65) Prior Publication Data

US 2002/0187660 A1 Dec. 12, 2002

(30) Foreign Application Priority Data

Apr. 26, 2001 (JP) ..... 2001-129413

(51) Int. Cl.[7] ..... H01R 9/05
(52) U.S. Cl. ..... 439/582
(58) Field of Search ..... 439/582, 585, 439/394, 63

(56) References Cited

U.S. PATENT DOCUMENTS 5,263,877 A * 11/1993 Mitani ..... 439/585
5,482,475 A * 1/1996 Kawaguchi ..... 439/394
5,772,470 A * 6/1998 Togashi ..... 439/582
5,879,190 A * 3/1999 Maruyama et al. ..... 439/582
6,503,100 B2 * 1/2003 Yamane ..... 439/582
6,508,668 B1 * 1/2003 Yamane ..... 439/582
6,712,645 B1 * 3/2004 Chou ..... 439/582

* cited by examiner

*Primary Examiner*—Gary Paumen

(74) *Attorney, Agent, or Firm*—Diller, Ramik & Wight

(57) ABSTRACT

A coaxial cable connector 1 including a connection terminal (2) to be connected to an internal conductor (34) of a coaxial cable 31 and a metal shell (4) for supporting the connection terminal (2) via an insulating member 3 establishes electrical connection between the internal conductor (34) of the coaxial cable (31) and the connection terminal (2) by bending the connection terminal (2) according to the respective bending forces of the shell (4) and the insulating member (3) and making such connection terminal (2) retain the internal conductor (34) of the coaxial cable (31).

7 Claims, 9 Drawing Sheets

COAXIAL CABLE CONNECTOR

CROSS REFERENCE TO RELATED APPLICATIONS

This application is based upon and claims the benefit of priority from the prior Japanese Patent Application No. 2001-129413 filed on Apr. 26, 2001; the entire contents of this prior application being incorporated herein by reference.

BACKGROUND OF THE INVENTION

1. Field of the Invention

The present invention relates to a cable-relay connector used in IT devices such as laptop computers and compact electronic devices such as home electric appliances, and particularly to a coaxial cable connector for connecting coaxial cables.

2. Description of the Related Art

Numerous coaxial cables are used for the internal wiring of IT devices such as laptop computers and compact electronic devices such as home electric appliances, and such coaxial cables are usually used by being electrically connected to the respective conductors of other cables, substrates or the like.

In order to electrically connect such coaxial cables to, for example, a conductor of another cables, conventionally, internal conductors of the respective coaxial cables were one by one soldered to the conductor of other corresponding cables. As a result, internal conductors of coaxial cables were electrically connected to the conductors of other cables.

Nevertheless, with this electrical connection method, connection errors during the soldering process would often occur, and there is a problem in that the electrical connection between the internal conductors of coaxial cables and the conductors of other cables could not be conducted with precision.

Moreover, since the soldering process is complicated, there is a problem in that much time is required for the connection process, and that the loss is great due to failures of the connection process.

In order to overcome such problems, conventionally, a coaxial cable connector has been proposed as a device for electrically connecting the internal conductors of coaxial cables and the conductors of other cables.

With this conventional coaxial cable connector, a connection terminal for electrically connecting to the internal conductors of coaxial cables is provided inside a shell, and such connection terminal is constituted by a pair of armatures formed by bending metal blade springs.

With this conventional coaxial cable connector, when the internal conductors of coaxial cables are engagably inserted into the opening of the shell, such internal conductors are engagably inserted between the pair of armatures, which are connection terminals, and retained by such pair of armatures by the resilience thereof. The internal conductors of coaxial cables and the connection terminals are electrically connected thereby.

Further, the coaxial cable connector connected to this internal conductor may be engagably connected to a separate relay connector. Upon electrically connecting beforehand a conductor of another cable to a contact portion of such separate relay connector and engagably connecting a coaxial cable to this separate relay connector, since the aforementioned connection terminal and the contact portion will become engaged, the internal conductor of the coaxial cable may thereby be electrically connected to the conductor of another cable.

According to this type of conventional coaxial cable connector, it is possible to prevent, as much as possible, connection errors since soldering operations are not required for the electrical connection of the internal conductor of the coaxial cable and the conductor of another cable, and it is thereby possible to conduct such electrical connection with precision. Moreover, since soldering operations are not required, the connection process is simplified, the operation time is shortened, and losses caused by failures of the connection process can be decreased as much as possible.

Meanwhile, with the conventional coaxial cable connector, the connection terminal thereof retains the internal conductor of the coaxial cable merely with its resilience in order to conduct the electrical connection of the internal conductor of the coaxial cable and the connection terminal. Thus, the retaining power for retaining the internal conductor is weak. As a result, when the coaxial cable electrically connected to the connection terminal is moved due to some kind of operation, there is a problem in that the internal conductor of the coaxial cable will separate from the connection terminal and the internal conductor of the coaxial cable and the connection terminal will no longer be in electrical connection, and the electrical connection between coaxial cables and other cables cannot be established thereby.

SUMMARY OF THE INVENTION

An object of the present invention is to provide a coaxial cable connector enabling a simplified connection process of coaxial cables while shortening the time required therefor, and which has small loss even upon the failure of the connection process, and which enables a further accurate connection of coaxial cables.

In order to achieve the foregoing object, the present invention provides a coaxial cable connector, comprising a connection terminal to be connected to an internal conductor of a coaxial cable; and a metal shell for supporting the connection terminal via an insulator, wherein the connection terminal is bent with respective bending forces of the shell and the insulator to make the connection terminal retain the internal conductor of the coaxial cable, so that electrical connection is established between the internal conductor of the coaxial cable and the connection terminal.

Other objects and advantages of the present invention will be more fully apparent from the ensuing detailed description and appended drawings.

DESCRIPTION OF THE EMBODIMENTS

Embodiments of the coaxial cable connector of the present invention is now described in detail in the following embodiments.

Figure 1:
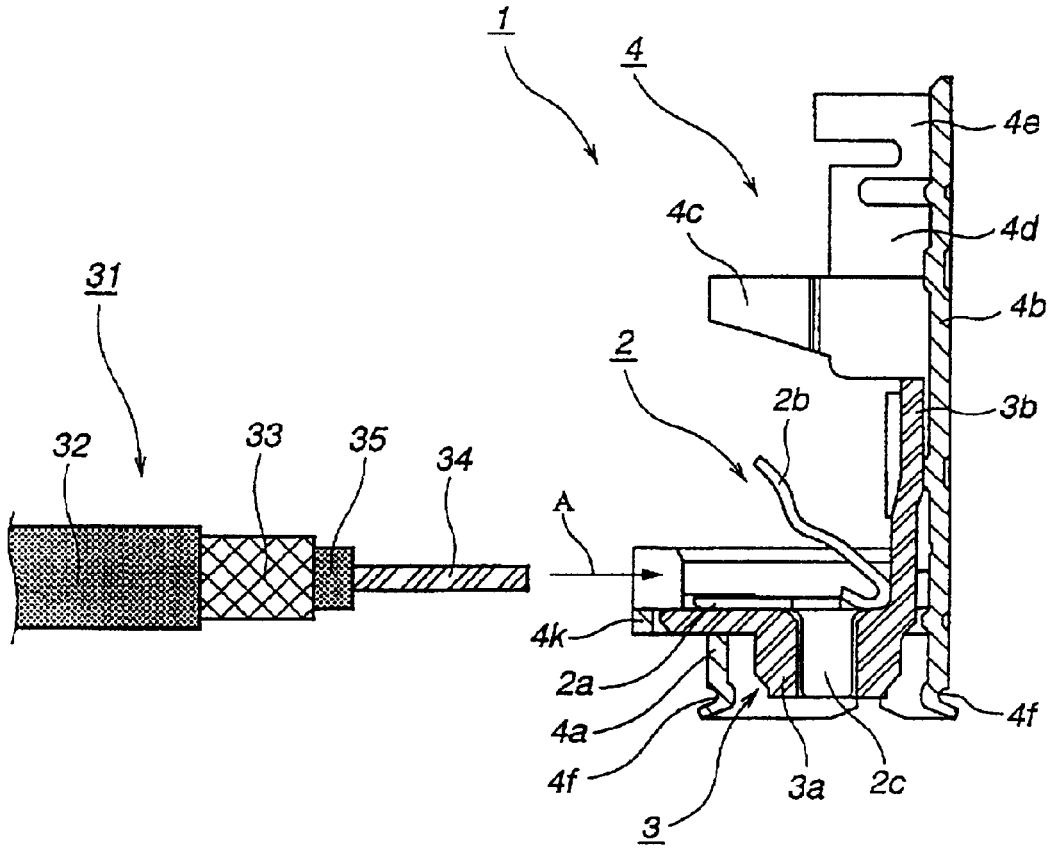
FIG. 1 is a schematic cross section of the relevant parts illustrating the coaxial cable connector of an embodiment according to the present invention, and, in particular, is a diagram showing the state of the coaxial cable connector prior to the connection of the coaxial cable.

FIG. 1 is a schematic cross section of the relevant parts of the coaxial cable connector of an embodiment according to the present invention, and, in particular, is a diagram showing the state of the coaxial cable connector prior to the connection of the coaxial cable.

This coaxial cable connector (hereinafter simply referred to as "connector") 1, as shown in FIG. 1, comprises a connection terminal 2 to be connected to an internal conductor 34 of a coaxial cable 31, and a metal shell 4 for supporting the connection terminal 2 via an insulating member 3.

Figure 2:
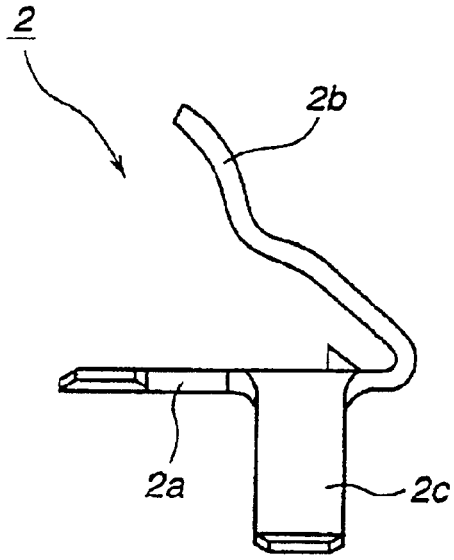
FIG. 2 is an enlarged schematic cross section of the connection terminal of the coaxial cable connector depicted in FIG. 1.

Among the above components, the connection terminal 2, as shown in in FIG. 2, which is an enlarged schematic front view of such connection terminal 2, is constituted by a pair of contacts 2*a*, 2*b* facing each other and formed by bending a metal blade spring into an approximate dogleg shape, and an engagement member 2*c* disposed on the contact 2*a* side among the pair of contacts 2*a*, 2*b*.

Figure 3:
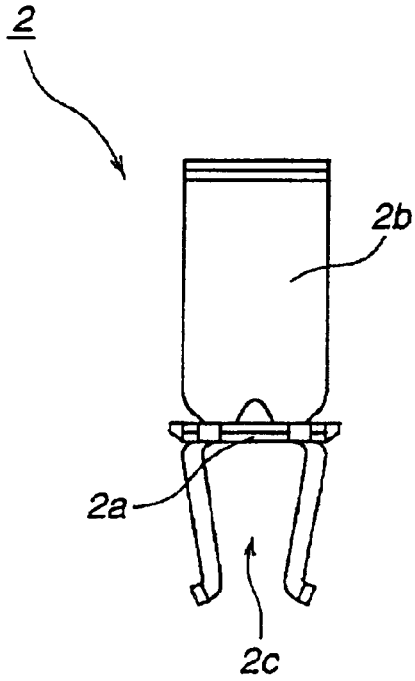
FIG. 3 is a left side view of the connection terminal of FIG. 2.

In addition, the engagement member 2*c* among the above, as shown in FIG. 3, which is a left side view of FIG. 2, is constituted by a pair of engagement tongue portions, and such pair of engagement tongue portions, as described later, engages with and retains a contact portion of a separate relay connector not shown.

Meanwhile, as shown in FIG. 1, the insulating member 3 disposed between the connection terminal 2 and shell 4 is constituted by an insulator main body 3*a* for supporting the contact 2*a* of the connection terminal, and an insulator bending portion 3*b* disposed on the other contact 2*b* side and bent toward the insulator main body 3*a*.

Figure 6A:
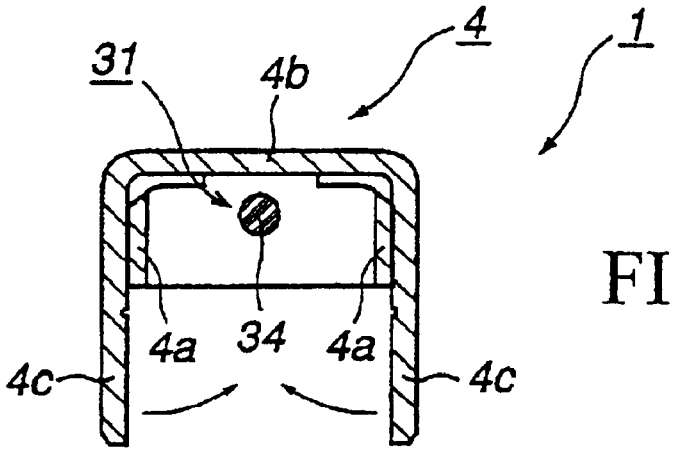
FIG. 6(*a*) through FIG. 6(*c*) are schematic cross sections of the relevant parts depicted in FIG. 5, respectively, and, in particular, FIG. 6(*a*) is a cross section of FIG. 5 viewed from VI(a)—VI(a), FIG. 6(*b*) is a cross section of FIG. 5 viewed from VI(b)—VI(b), and FIG. 6(*c*) is a cross section of FIG. 5 viewed from VI(c)—VI(c)
Figure 6B:
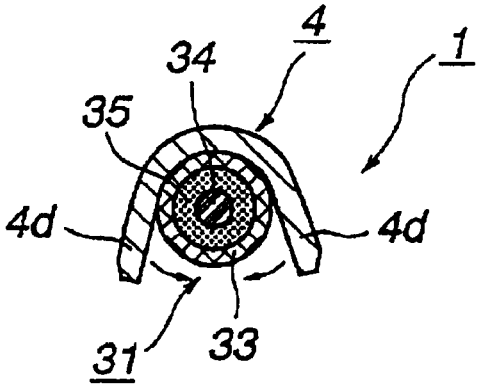
Figure 6C:
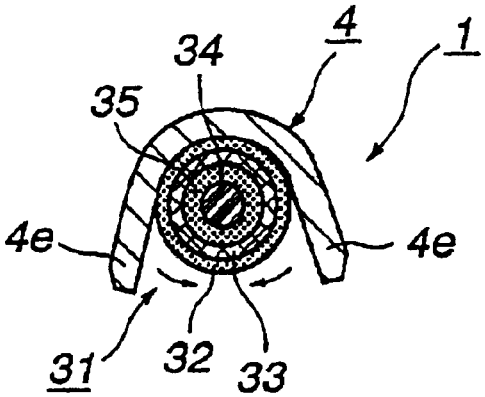

Further, the shell 4 is constituted by a shell main body 4*a* for supporting the insulator main body 3*a* of the insulating member 3, a shell bending portion 4*b* juxtaposed to the insulator bending portion 3*b* of the insulating member 3 and which is bent together with the insulator bending portion 3*b*, and a first engagement tongue portion 4*c* (engagement tongue portion) formed on each side (FIG. 6(*a*)) of the shell bending portion 4*b*, respectively.

Moreover, as shown in FIG. 1, a second engagement tongue portion 4*d* (FIG. 6(*b*)) and a third engagement tongue portion 4*e* (FIG. 6(*c*)) are respectively formed on both sides of the shell bending portion 4*b*, and such second engagement tongue portion 4*d* and third engagement tongue portion 4*e* are formed integrally.

In addition, an annular engagement groove 4*f* for engaging with the shell of the aforementioned separate relay connector is formed on the shell main body 4*a*.

Meanwhile, the coaxial cable 31 to be electrically connected with the connector 1 as structured above generally comprises an internal conductor 34 made of copper wire and an insulator 35 for directly circumscribing such copper wire disposed within an external conductor 33 circumscribed by an exterior covering 32.

To electrically connect its internal and external conductors 34 and 33 with the connector 1, the coaxial cable 31 partially exposes and uses the external conductor 33, insulator 35 and internal conductor 34 as shown in FIG. 1.

Next, the method of electrically connecting the internal conductor 34 of the coaxial cable 31 to the connector 1 is explained, and the structure of the connector 1 is described in detail.

In order to electrically connect the internal conductor 34 of the coaxial cable 31 to the connector 1 depicted in FIG. 1, the coaxial cable 31 is foremost moved to the connector 1 side as shown with the arrow A.

Figure 4:
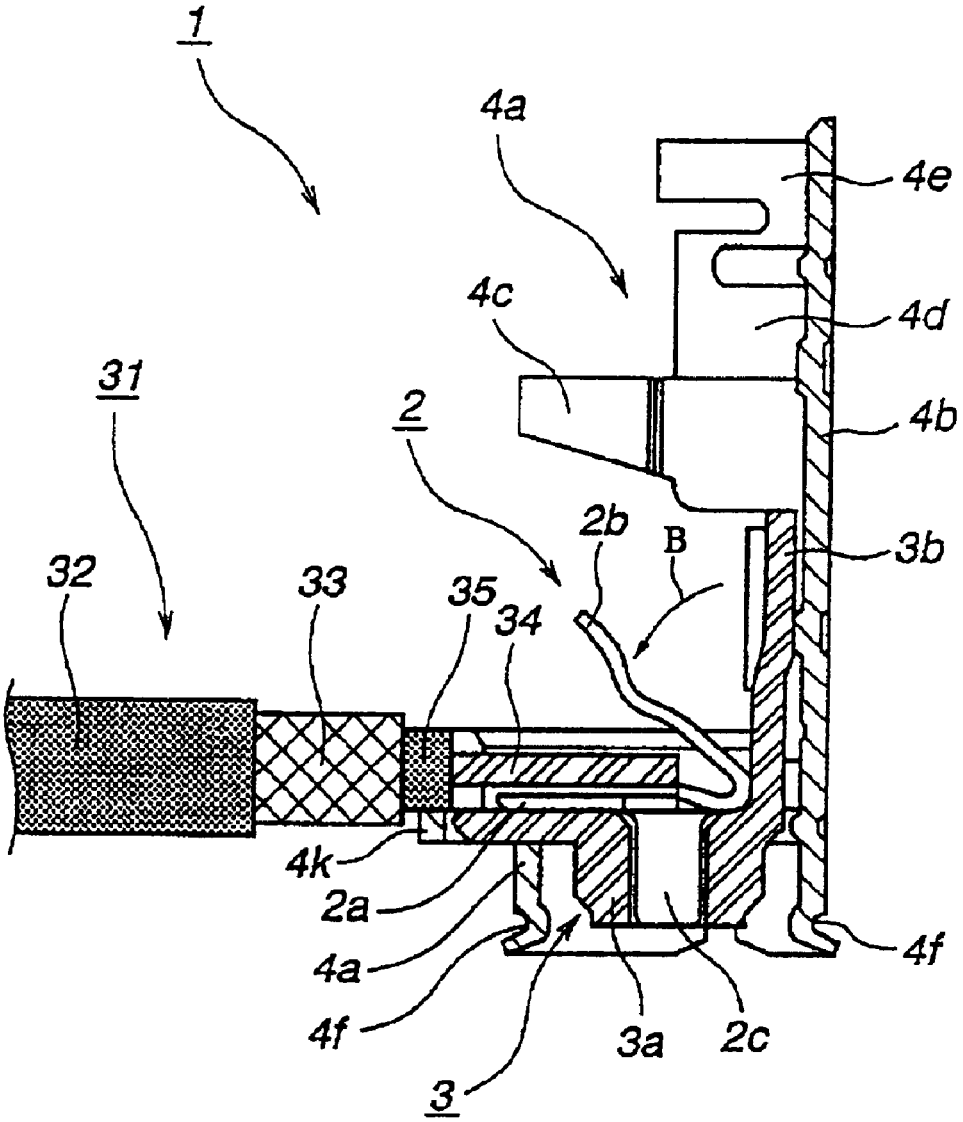
FIG. 4 is a schematic cross section of the relevant parts of the coaxial cable connector depicted in FIG. 1, and, in particular, is a diagram showing the operation of connecting coaxial cables.

Then, as shown in FIG. 4, the internal conductor 34 of the coaxial cable 31 is disposed between the contacts 2*a*, 2*b*.

Next, as shown with the arrow B of FIG. 4, the shell bending portion 4*b* and the insulator bending portion 3*b* are simultaneously bent toward the shell main body 4a and the insulator main body 3*a*.

Figure 5:
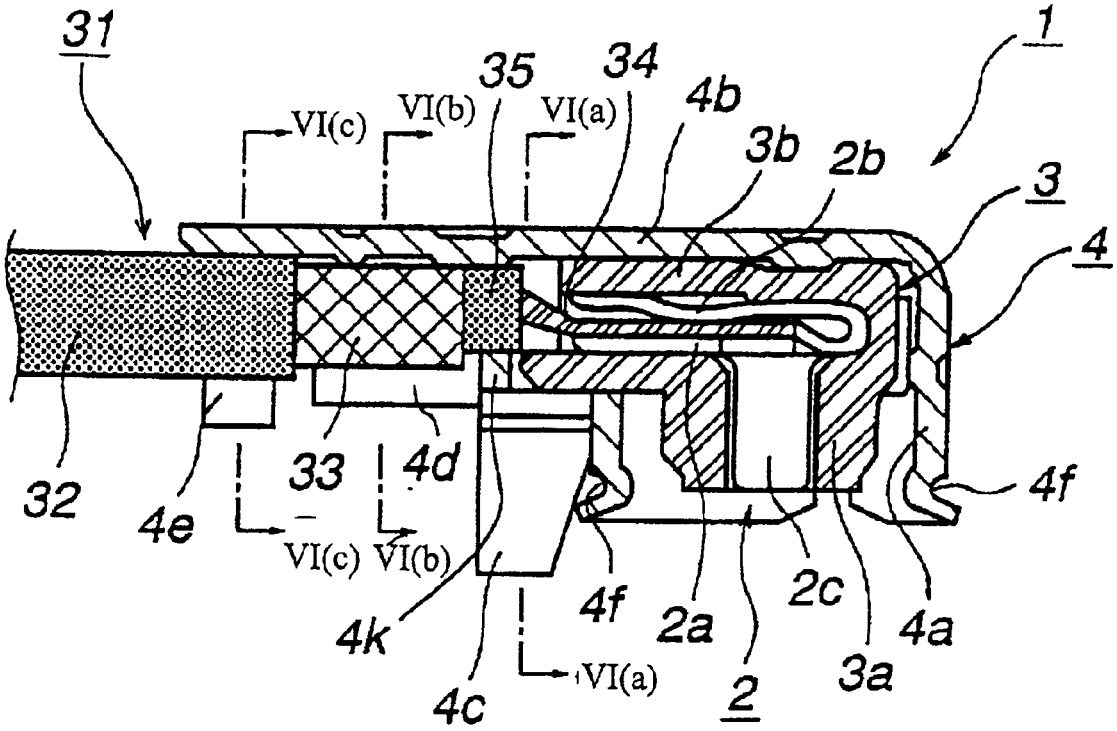
FIG. 5 is a schematic cross section of the relevant parts of the coaxial cable connector depicted in FIG. 1, and, in particular, is a diagram showing the state of having connected the coaxial cables.

Whereby, as shown in FIG. 5, the contact 2*b* structuring the connection terminal 2 presses the internal conductor 34 of the coaxial cable 31 to the contact 2*a* with the respective bending forces of the shell bending portion 4*b* and the insulator bending portion 3*b*. As a result, the pair of contacts 2*a*, 2*b* elastically deform and retain the internal conductor 34 of the coaxial cable 31 between them. The internal conductor 34 of the coaxial cable 31 and the connection terminal 2 are thereby electrically connected.

In the connector 1 electrically connected as described above, as shown in FIG. 5 and FIG. 6(*a*) that is a cross section of FIG. 5 viewed from VI(a)—VI(a), the shell bending portion 4*b* covers the insulator 35 and the internal conductor 34 of the coaxial cable 31 as well as the shell main body 4*a* and the insulator main body 3*a* of the connector 1 by means of the respective first engagement tongue portions 4*c* provided on both sides thereof.

Further, the tip of the respective first engagement tongue portions 4*c*, as shown in FIG. 5, is disposed below the support portion 4*k* of the shell main body 4*a* supporting the insulator 35 of the coaxial cable 31, and the insulator main body 3*a*.

In addition, the shell bending portion 4*b*, as shown in FIG. 5 and FIG. 6(*b*) which is a schematic cross section of FIG. 5 viewed from VI(b)—VI(b), covers the external conductor 33 of the coaxial cable 31 by means of the respective second engagement tongue portions 4*d*, and the tip of the respective second engagement tongue portions 4*d* is disposed below the external conductor 33 of the coaxial cable 31.

Further, as shown in FIG. 5 and FIG. 6(*c*) which is a schematic cross section of FIG. 5 viewed from VI(c)—VI (c), the shell bending portion 4*b* covers the exterior covering 32 of the coaxial cable 31 by means of the respective third engagement tongue portions 4*e*. The tip of the third engagement tongue portions 4*e* is disposed below the exterior covering 32 of the coaxial cable 31.

Figure 7A:
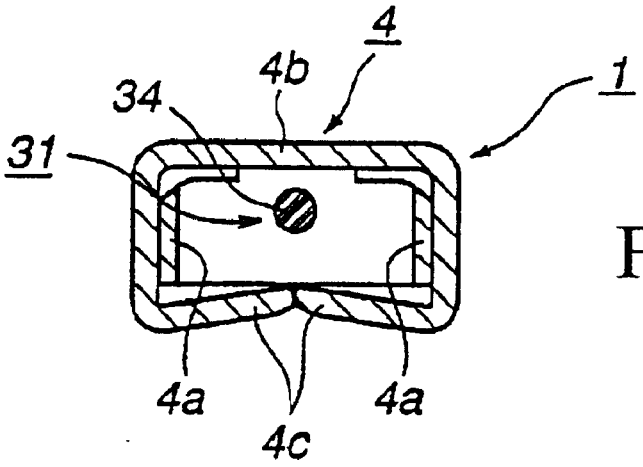
FIG. 7(*a*) through FIG. 7(*c*) are schematic cross sections of the relevant parts showing the coaxial cable connector in which the connected between the coaxial cable and connection terminal is maintained, and, in particular, FIG. 7(*a*) is a diagram showing the state where the first engagement tongue portion depicted in FIG. 6(*a*) is engaged with the coaxial cable insulator, FIG. 7(*b*) is a diagram showing the state where the second engagement tongue portion depicted in FIG. 6(*b*) is engaged with and retained by the external conductor of the coaxial cable, and FIG. 7(*c*) is a diagram showing the state where the third engagement tongue portion depicted in FIG. 6(*c*) is engaged with and retained by an exterior covering of the coaxial cable.
Figure 7B:
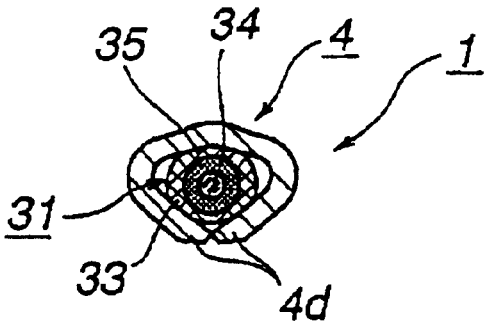
Figure 7C:
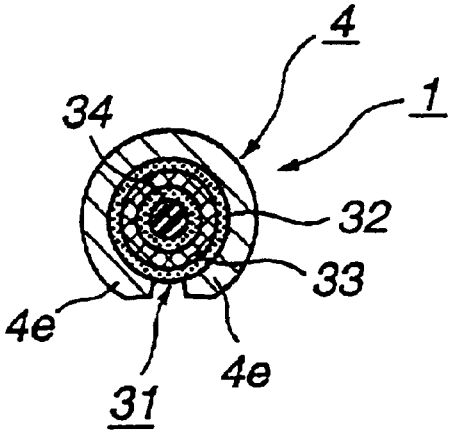

Then, as shown in FIG. 7(*a*), the respective first engagement tongue portions 4*c* are each pushed toward the internal width direction of the shell main body 4*a* and the insulator main body 3*a*, and engaged with the shell main body 4*a* and the insulator main body 3*a*.

Figure 8:
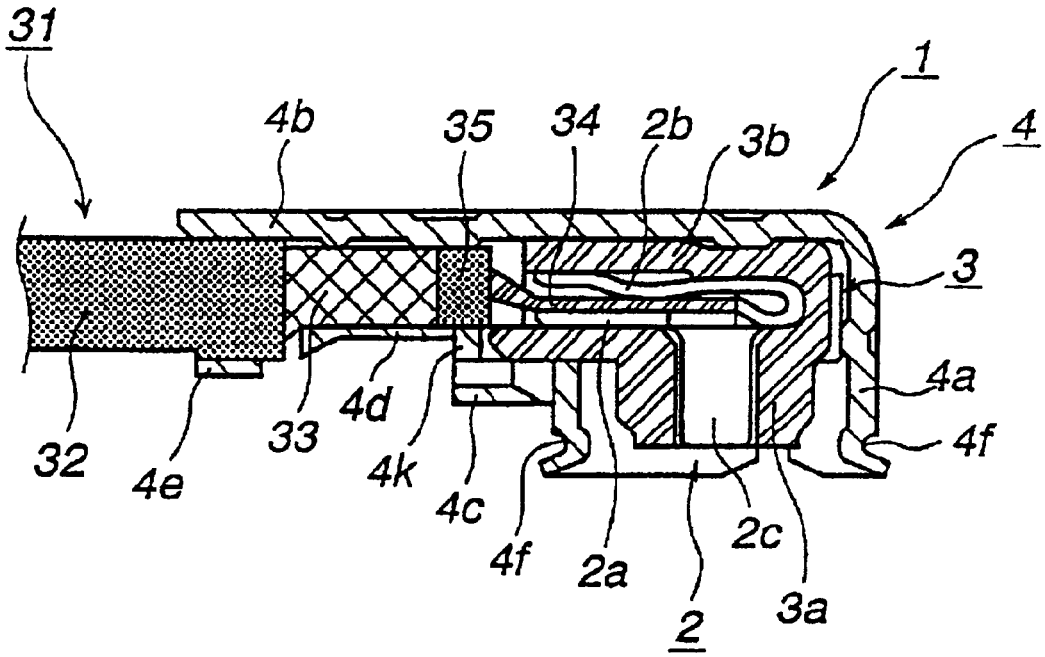
FIG. 8 is a schematic cross section of the relevant parts of the coaxial cable connector depicted in FIG. 1, and, in particular, is a diagram showing the state where connection between the coaxial cable and the connection terminal is maintained.

Whereby, as shown in FIG. 8 which is a schematic cross section of the connector 1, the respective bending forces upon bending the shell bending portion 4*b* and the insulator bending portion 3*b* can be retained, and it is thereby possible to maintain the connection terminal 2 in a state where it is retaining the internal conductor 34. The electrical connection of the internal conductor 34 of the coaxial cable 31 and the connection terminal 2 can be maintained thereby.

Moreover, by making the respective second engagement tongue portions 4*d* depicted in FIG. 6(*b*) engage with and retain the external conductor 33 of the coaxial cable 31 as shown in FIG. 7(*b*) and FIG. 8, the respective bending forces generated upon bending the shell bending portion 4*b* and the insulator bending portion 3*b* can be further retained. The electrical connection of the internal conductor 34 of the coaxial cable 31 and the connection terminal 2 can be further maintained thereby. Therefore, the electrical connection of the internal conductor 34 of the coaxial cable 31 and the connection terminal 2 can be maintained securely.

Moreover, by additionally making the respective third engagement tongue portions 4*e* depicted in FIG. 6(*c*) engage with and retain the exterior covering 32 of the coaxial cable 31 as shown in FIG. 7(*c*) and FIG. 8, the respective bending forces generated upon bending the shell bending portion 4*b* and the insulator bending portion 3*b* can be further retained. The electrical connection of the internal conductor 34 of the coaxial cable 31 and the connection terminal 2 can be further maintained thereby. Therefore, the electrical connection of the internal conductor 34 of the coaxial cable 31 and the connection terminal 2 can be maintained even more securely.

The state of electrically connecting the connector 1 with the internal conductor 34 of the coaxial cable 31 as described above is shown in FIG. 9, which is a schematic side view of the connector 1.

Figure 9:
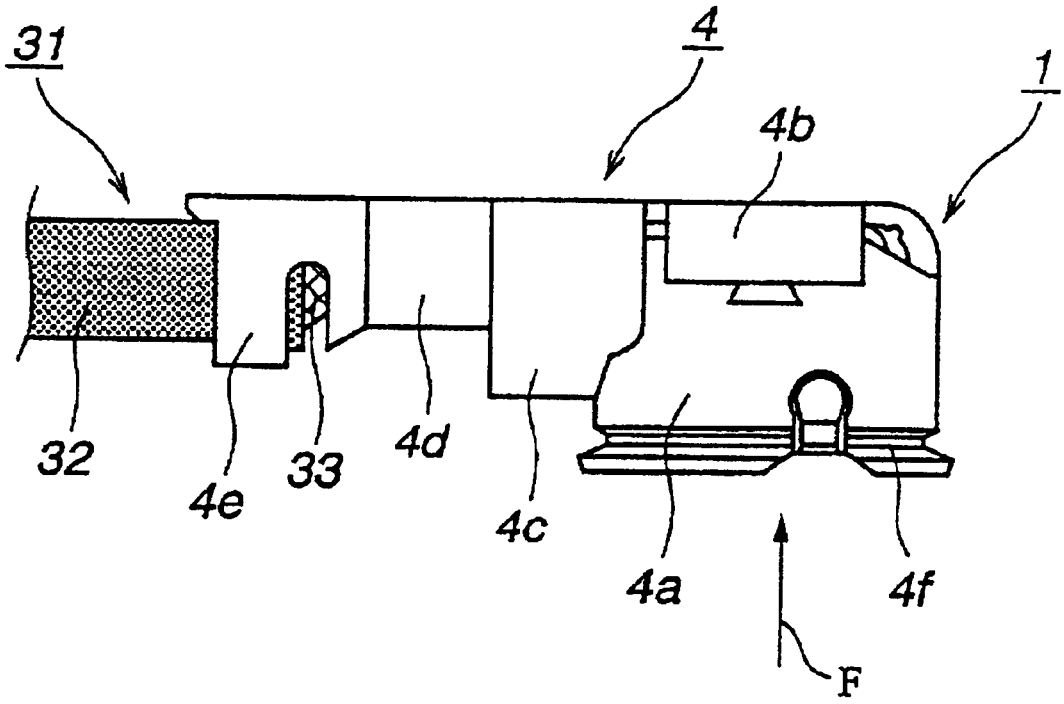
FIG. 9 is a schematic side view of the coaxial cable connector depicted in FIG. 1, and, in particular, is a schematic side view showing the state where connection between the coaxial cable and the connection terminal is maintained.

The connector 1 can be engagably attached to the aforementioned separate relay connector (not shown) via the annular engagement groove 4*f* of the shell main body 4*a* depicted in FIG. 9.

By electrically connecting beforehand a conductor of a separate cable not shown to the aforementioned contact portion of the separate relay connector and engagably attaching the shell of such separate relay connector to the engagement groove 4*f* of the connector 1 from the direction of the arrow F, the engagement member 2*c* (FIG. 3) of the connection terminal 2 engages with and retains the contact portion. It is thereby possible to establish the electrical connection of the internal conductor 34 of the coaxial cable 31 and a conductor of other cables.

Moreover, with the connector 1 which seeks the electrical connection of the internal conductor 34 of the coaxial cable 31 and the conductor of other cables, as described above, the connection terminal 2 of the connector 1 and the internal conductor 34 of the coaxial cable 31 are electrically connected by the respective bending forces of the shell bending portion 4*b* and the insulator bending portion 3*b* applied externally. Thus, in comparison to the conventional electrical connections of retaining the internal conductor 34 of the coaxial cable 31 only with the resilience of the connection terminal 2, the power of retaining the internal conductor 34 is greater. As a result, it is possible to prevent, as much as possible, the internal conductor 34 of the coaxial cable 31 from separating from the connection terminal 2 even in cases where the coaxial cable 31 electrically connected with the connection terminal 2 is moved by some kind of operation.

Therefore, it is possible to electrically connect the internal conductor 34 of the coaxial cable 31 to the connection terminal 2 with certainty, and the electrical connection of the internal conductor 34 of the coaxial cable 31 with a conductor of other cables can thereby be secured.

Further, with this connector 1, a first engagement tongue portion 4*c*, a second engagement tongue portion 4*d* and a third engagement tongue portion 4*e* are formed on the side of the shell bending portion 4*b*, and these engagement tongue portions 4*c*, 4*d*, 4*e* are respectively engaged with the shell main body 4*a* so as to retain the respective bending forces generated upon bending the shell bending portion 4*b* and the insulator bending portion 3*b*. Thus, as described above, the separation of the coaxial cable 31 is prevented, and it is thereby possible to maintain for a long period of time the electrical connection, in which such connection is secured, of the internal conductor 34 of the coaxial cable 31 and the connection terminal 2.

Moreover, the shell bending portions 4*b* of the shell 4 directly engage with the external conductor 33 of the coaxial cable 31 and the exterior covering 32, respectively, pursuant to the second engagement tongue portion 4*d* and the third engagement tongue portion 4*e*. Thus, such engagements also prevent the coaxial cable 31 from separating from the connection terminal 2, and it is thereby possible to maintain for a long period of time the electrical connection, in which such connection is secured, of the internal conductor 34 of the coaxial cable 31 and the connection terminal 2.

In addition, with this connector 1, since a soldering process in not necessary to establish the electrical connection of the internal conductor 34 of the coaxial cable 31 and a conductor of other cables, it is possible to prevent connection errors as much as possible, thereby enabling the secure electrical connection of the internal conductor 34 of the coaxial cable 31 and the connection terminal 2. Thus, the electrical connection of the internal conductor 34 of the coaxial cable 31 and the conductor of other cables can be established with certainty.

Further, with this connector 1, since a soldering process in not necessary to establish the electrical connection of the internal conductor 34 of the coaxial cable 31 and a conductor of other cables, the connection process is simplified, the operation time is shortened thereby, and the loss caused by failures of the connection process can be reduced as much as possible.

With the connector 1 of the foregoing embodiment, the shell bending portion 4*b* of the shell 4 and the insulator bending portion 3*b* of the insulating member 3 are, as shown with the arrow B in FIG. 4, bent so as to cover the internal conductor 34 of the coaxial cable 31 from above, and the connection terminal 2 is bent so as to retain the internal conductor 34 from the vertical direction with the respective bending forces of the shell bending portion 4*b* and the insulator bending portion 3*b*. Nevertheless, the connector of this invention does not limit the bending direction of the shell bending portion 4*b*, insulator bending portion 3*b* and connection terminal 2. For example, as shown in FIG. 10, which is a schematic planar cross section of a connector 21 of another embodiment, the shell bending portion 24*b* of the shell 24 and the insulator bending portion 23*b* of the insulating member 23 may be bent toward the internal conductor 34 of the coaxial cable 31 from both sides of such internal conductor 34, respectively, and the connection terminal 22 may be elastically deformed so as to retain the internal conductor 34 from both sides with the respective bending forces of the shell bending portion 24*b* and the insulator bending portion 23*b*.

Figure 10:
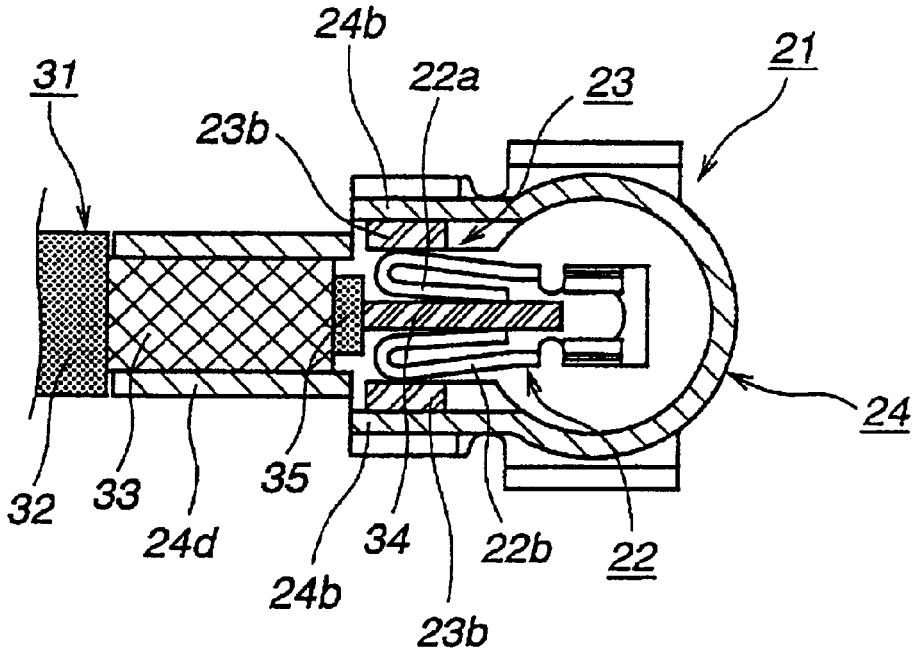
FIG. 10 is a schematic planar cross section showing the coaxial connection of another embodiment according to the present invention, and, in particular, is a diagram showing the state where the coaxial cable and connection terminal are connected, and such connection being maintained.

Moreover, although not shown in FIG. 10, the shell bending portion 24*b* of the shell 24 is engaged with the shell main body via an engagement tongue portion formed on the shell bending portion 24*b*. Reference numeral 24*d* in FIG. 10 is the engagement tongue portion formed on the shell bending portion 24*b*, and is an engagement tongue portion for engaging with and retaining the external conductor 33 of the coaxial cable 31.

As described above, with the coaxial cable connector according to the present invention, the connection terminal of the connector and the internal conductor of the coaxial cable are electrically connected with the respective bending forces of the shell bending portion and the insulator bending portion applied externally. Thus, in comparison to the conventional electrical connections of retaining the internal conductor of the coaxial cable only with the resilience of the connection terminal, the power of retaining the internal conductor is greater. As a result, it is possible to prevent, as much as possible, the internal conductor of the coaxial cable from separating form the connection terminal even in cases where the coaxial cable electrically connected with the connection terminal is moved by some kind of operation. Thereby, the electrical connection of the internal conductor of the coaxial cable and the conductor of other cables can be sought with certainty. Since a soldering process in not necessary upon seeking the electrical connection of the internal conductor of the coaxial cable and a conductor of other cables, the connection process is simplified, the operation time is shortened thereby, and the loss caused by failures of the connection process can be reduced as much as possible.

What is claimed is:

1. A coaxial cable connector, comprising:

a connection terminal to be connected to an internal conductor of a coaxial cable; and a metal shell for supporting the connection terminal via an insulator, wherein the connection terminal is bent with respective bending forces of the shell and the insulator to make the connection terminal retain the internal conductor of the coaxial cable, so that electrical connection is established between the internal conductor of the coaxial cable and the connection terminal.

2. A coaxial cable connector according to claim 1, wherein the connection terminal comprises a pair of contacts facing each other that are formed by bending a blade spring in an approximate dogleg shape.

3. A coaxial cable connector according to claim 1, wherein the insulator comprises an insulator main body that supports one contact of the pair of contacts, and an insulator bending portion disposed at the side of another contact of the pair of contacts with respect to the insulator main body.

4. A coaxial cable connector according to claim 1, wherein the shell comprises a shell main body that supports the insulator main body, and a shell bending portion juxtaposed to the insulator bending portion.

5. A coaxial cable connector according to claim 4, wherein the shell comprises an engagement tongue portion at the side of the shell bending portion.

6. A coaxial cable connector according to claim 1, wherein the connection terminal comprises a pair of contacts facing each other that are formed by bending a blade spring in an approximate dogleg shape;

the insulator comprises an insulator main body that supports one contact of the pair of contacts, and an insulator bending portion disposed at the side of another contact of the pair of contacts with respect to the insulator main body;

the shell comprises a shell main body that supports the insulator main body, and a shell bending portion juxtaposed to the insulator bending portion; and the shell bending portion and the insulator bending portion are bent toward the shell main body and the insulator main body, respectively, after disposing the internal conductor of the coaxial cable between the pair of contacts, whereby the another contact is caused to press the internal conductor of the coaxial cable against the one contact according to the respective bending forces of the shell bending portion and the insulator bending portion, so that the pair of contacts retains the internal conductor of the coaxial cable and electrically connects the internal conductor of the coaxial cable and the connection terminal.

7. A coaxial cable connector according to claim 1, wherein the connection terminal comprises a pair of contacts facing each other that are formed by bending a blade spring in an approximate dogleg shape;

the insulator comprises an insulator main body that supports one contact of the pair of contacts, and an insulator bending portion disposed at the side of another contact of the pair of contacts with respect to the insulator main body;

the shell comprises a shell main body that supports the insulator main body, a shell bending portion juxtaposed to the insulator bending portion and an engagement tongue portion provided at the side of the shell bending portion;

the shell bending portion and the insulator bending portion are bent toward the shell main body and the insulator main body, respectively, after disposing the internal conductor of the coaxial cable between the pair of contacts, whereby the another contact is caused to press the internal conductor of the coaxial cable against the one contact according to the respective bending forces of the shell bending portion and the insulator bending portion, so that the pair of contacts retains the internal conductor of the coaxial cable and electrically connects the internal conductor of the coaxial cable and the connection terminal; and the engagement tongue portion is engaged with the shell main body, whereby the electrical connection of the internal conductor of the coaxial cable and the connection terminal is maintained.

* * * * *